US008628181B2

(12) United States Patent
Usuda et al.

(10) Patent No.: US 8,628,181 B2
(45) Date of Patent: Jan. 14, 2014

(54) RECORDING APPARATUS

(75) Inventors: Hidenori Usuda, Matsumoto (JP); Shinichi Kamoshida, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 52 days.

(21) Appl. No.: 13/285,797

(22) Filed: Oct. 31, 2011

(65) Prior Publication Data

US 2012/0127237 A1 May 24, 2012

(30) Foreign Application Priority Data

Nov. 24, 2010 (JP) ..... 2010-261491

(51) Int. Cl.
*B41J 2/165* (2006.01)

(52) U.S. Cl.
USPC ..... 347/95

(58) Field of Classification Search
None
See application file for complete search history.

(56) References Cited

U.S. PATENT DOCUMENTS

| | | | | |
|---|---|---|---|---|
| 6,283,589 | B1 * | 9/2001 | Gelbart | 347/101 |
| 6,550,882 | B2 | 4/2003 | Koitabashi et al. | |
| 6,644,763 | B1 * | 11/2003 | Gothait | 347/1 |
| 2008/0122882 | A1 * | 5/2008 | Huang et al. | 347/9 |

FOREIGN PATENT DOCUMENTS

| | | |
|---|---|---|
| JP | 2001-270094 | 10/2001 |
| JP | 2002-154195 | 5/2002 |

* cited by examiner

*Primary Examiner* — Matthew Luu
*Assistant Examiner* — Alejandro Valencia
(74) *Attorney, Agent, or Firm* — Workman Nydegger

(57) ABSTRACT

A recording apparatus includes a first nozzle for ejecting a first type of liquid for base coating onto a recording target medium and a second nozzle for ejecting a second type of liquid onto a base formed as a result of the base coating. A distance between the first nozzle and the recording target medium is shorter than a distance between the second nozzle and the recording target medium.

17 Claims, 5 Drawing Sheets

RECORDING APPARATUS

This application claims the benefit of Japanese Patent Application No. 2010-261491, filed on Nov. 24, 2010, which is incorporated by reference herein in its entirety.

BACKGROUND

1. Technical Field

The present invention relates to a recording apparatus that records an image, etc, on a recording target medium. In the following description of this specification, the term "recording apparatus" encompasses various kinds of apparatuses such as an ink-jet printer, a line printer, a copying machine, and a facsimile machine, without any limitation thereto.

2. Related Art

As disclosed in JP-A-2002-154195, a recording apparatus according to related art is equipped with a head for ejecting treatment liquid (surface treatment liquid) and another head. For recording, ink is ejected from another head mentioned above. The treatment liquid is ejected onto the surface of the ink ejected for recording. A distance between the head for ejecting the treatment liquid and a recording target medium is longer than a distance between another head mentioned above and the recording target medium. Since the recording apparatus has such a structure, there is a space where the mist of the treatment liquid drifts, which makes it possible to almost perfectly prevent the mist of the treatment liquid from reaching the ink ejection surface of another head mentioned above.

A recording apparatus disclosed in JP-A-2001-270094 includes a print head that has a plurality of nozzles. The plurality of nozzles is formed in such a way as to meet the following conditions: a distance between the nozzle for forming the last dot and a print target medium is larger than a distance between the nozzle for forming the first dot and the print target medium. The distance is increased in accordance with the amount of permeation of ink. By this means, even when cockling occurs as a result of the permeation of ink, it is possible to avoid the contact of a print head and a print target medium.

However, the scope of the application of the structure disclosed in JP-A-2002-154195 is limited to the treatment liquid (surface treatment liquid) ejected by the head onto the surface of the ink ejected from another head mentioned above for recording. It is not directed to liquid for base coating. The scope of the application of the structure disclosed in JP-A-2001-270094 is limited to a measure against cockling, which becomes more conspicuous as the amount of permeation of ink increases. A relationship between liquid for base coating and liquid ejected onto a base formed as a result of the base coating is not considered at all therein.

SUMMARY

An advantage of some aspects of the invention is to provide a recording apparatus designed with consideration given to ejecting liquid for base coating.

A recording apparatus according to a first aspect of the invention includes: a first nozzle for ejecting a first type of liquid for base coating onto a recording target medium; and a second nozzle for ejecting a second type of liquid onto a base formed as a result of the base coating; wherein a distance between the first nozzle and the recording target medium is shorter than a distance between the second nozzle and the recording target medium. Since there is the above relationship therebetween, a recording apparatus according to the above aspect of the invention makes the distance (PG1) between the first nozzle and the recording target medium at the time of base coating (basecoat printing) approximately equal to an actual distance (PG2') between the second nozzle and the surface of the base coating layer at the time of recording (printing) thereon, thereby making it possible to improve recording quality. In other words, it is possible to avoid problems caused by a decrease, the amount of which is equal to the thickness of the base coating layer, in the distance between the nozzle and the area where the discharged liquid droplets land on the recording target medium. For example, there is no risk of abrasion of the layer on the recording target medium by the nozzle surface of the recording head. The first nozzle and the second nozzle may be formed in a single recording head. Alternatively, they may be formed in separate recording heads.

In a second mode of the invention, preferably, a recording apparatus according to the above aspect of the invention further includes a first recording head that has the first nozzle and a second recording head that has the second nozzle, wherein the first recording head is separated from the second recording head. In addition to the operational effects produced by the first aspect of the invention, such a preferred structure makes it possible to perform recording operation by the first recording head and recording operation by the second recording head separately, which is useful.

In a third mode of the invention, preferably, a recording apparatus according to the second mode of the invention described above further includes a distance changer for changing a distance between the first recording head and the recording target medium. In addition to the operational effects produced by the second mode of the invention, such a preferred structure makes it possible to set the distance between the first recording head and the recording target medium at an appropriate value. For example, when the first type of liquid is ejected to form a liquid layer that is made up of three tiers, it is possible to set the distance between the first recording head and the recording target medium at an appropriate value. Therefore, there is no risk that any foreign particle, object, etc. on the recording target medium sticks to the first recording head because of a too close distance therebetween. Since there is no risk of such sticking, "missing dot" does not occur. Herein, the term "missing dot" means the following phenomenon: when a liquid droplet discharged from a certain nozzle is trapped by a foreign object sticking to the nozzle and thus does not land on a recording target medium, no dot (spot of the landing of a liquid droplet) is formed at the point where the droplet is supposed to land.

In a fourth mode of the invention, preferably, in any of the first aspect, the second mode, and the third mode of the invention, each of the first type of liquid and the second type of liquid is photo-curable ink. Herein, the term "photo-curable ink" means ink that cures (solidifies) when exposed to light. An example of photo-curable ink is ultraviolet ray curing (solidification) ink (UV ink), which cures (solidifies) when exposed to ultraviolet rays. A change in the volume of ultraviolet ray curing ink in the process of curing (solidification) is far smaller than that of dye ink and pigment ink, each of which cures (solidifies) as a result of the vaporization of its solvent. In addition to the operational effects produced by the above modes/aspect of the invention, since the liquid is photo-curable ink, the following effects can be expected with such a preferred structure. The base coating layer is formed by means of the first type of liquid. As compared with the distance before the forming of the base coating layer, there is a change in terms of distance, specifically, a change into the distance between the second nozzle, from which the liquid is ejected thereafter, and the surface on which the discharged liquid droplets land (i.e., the surface of the base coating layer) over the recording target medium. Therefore, the structure having the above relationship regarding the distance is especially effective for this mode.

In a fifth mode of the invention, preferably, in any of the first aspect, the second mode, the third mode, and the fourth mode of the invention, there is a recording mode in which the second type of liquid is ejected from the second nozzle onto an area where the first type of liquid has been ejected from the first nozzle. In addition to the operational effects produced by the first aspect, the second mode, the third mode, and the fourth mode of the invention, the structure having the above relationship regarding the distance is especially effective when the modes include the above recording mode.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
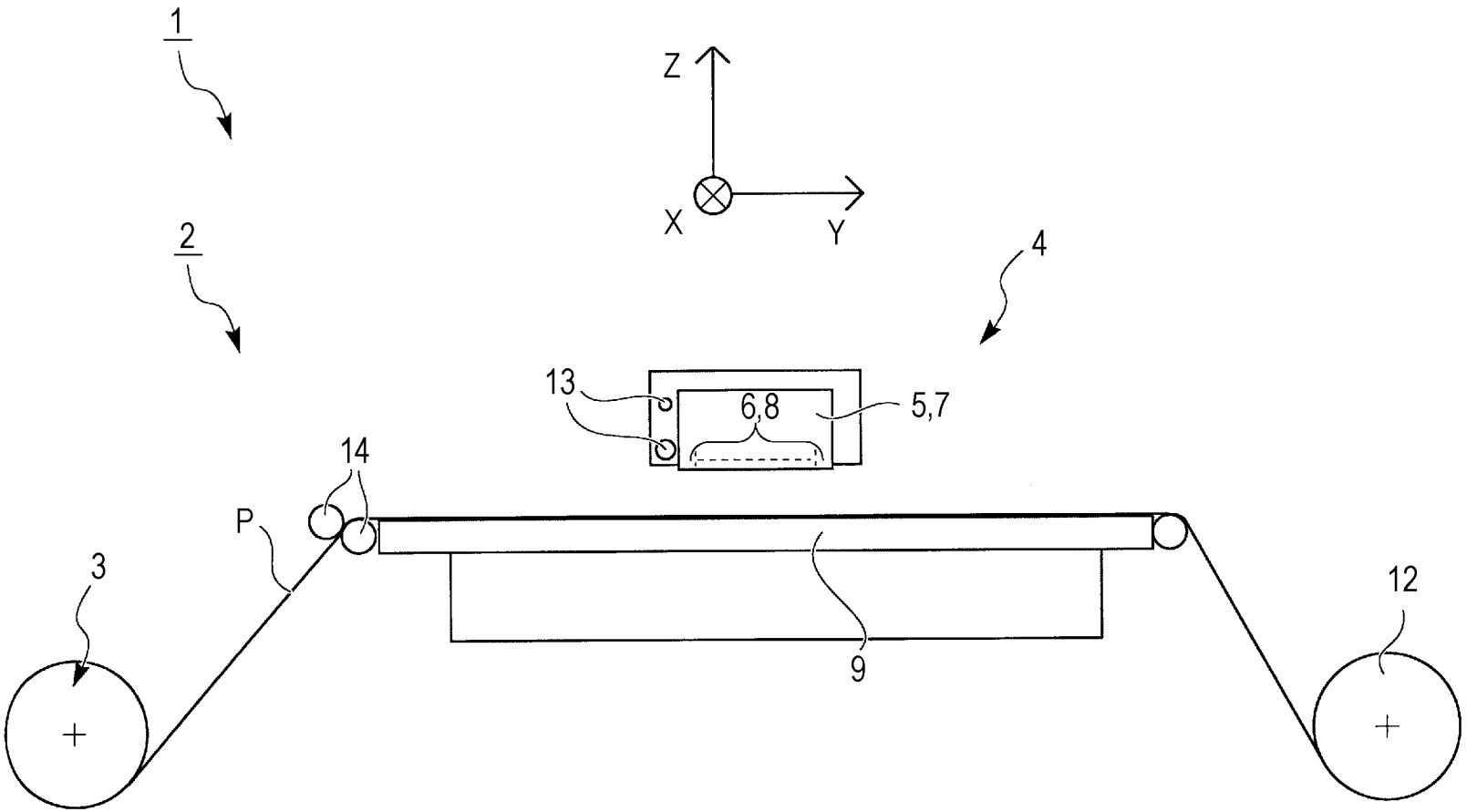
FIG. 1 is a side view that schematically illustrates a printer according to an exemplary embodiment of the invention.

With reference to the accompanying drawings, exemplary embodiments of the present invention will now be explained in detail. FIG. 1 is a side view that schematically illustrates the structure of a printer, which is an example of a recording apparatus according to an exemplary embodiment of the invention. As illustrated in FIG. 1, a printer 1 includes a medium feeding means 2, a recording unit 4, and a reeling means 12. The reeling means 12 is an example of an ejector. The medium feeding means 2 is configured to be able to feed roll paper P, which is a kind of a roll-type medium, to a downstream side in a feeding direction (the direction shown by an arrow along the Y axis). The roll-type medium is an example of a recording target medium. In addition, the roll-type medium is an example of a medium that is to be fed.

Specifically, the medium feeding means 2 includes an unreeling feeder 3 and a pair of rollers 14. The unreeling feeder 3 is configured to be able to roll out the paper P, which is in the form of a roll before feeding, and feed it to the downstream side in the feeding direction. The pair of rollers 14 is configured to be able to direct the rolled-out paper P to the recording unit 4. The recording unit 4 is provided downstream of the pair of rollers 14. The recording unit 4 ejects ink onto the rolled-out paper P at a recording region, which is located downstream of the medium feeding means 2. The recording unit 4 includes recording heads, nozzles, and a medium supporting means. Specifically, the recording unit 4 includes a first recording head 5, a second recording head 7, a first group of nozzles 6, a second group of nozzles 8, and a medium supporting unit 9. The first recording head 5 and the second recording head 7 are configured to be able to move along a guiding shaft 13 in the width direction X of the rolled-out paper P when driven by a driving motor that is not illustrated in the drawings.

The first group of nozzles 6 from which ink droplets are discharged is formed in the nozzle surface of the first recording head 5. The nozzle surface of the first recording head 5 faces the medium supporting unit 9. In like manner, the second group of nozzles 8 is formed in the nozzle surface of the second recording head 7. The nozzle surface of the second recording head 7 also faces the medium supporting unit 9. The medium supporting unit 9 supports the rolled-out paper P and can keep a distance PG1 between the rolled-out paper P and the first recording head 5 at a predetermined distance and keep a distance PG2 between the rolled-out paper P and the second recording head 7 at another predetermined distance. The Z axis direction is a direction along which the medium supporting unit 9 and the first recording head 5 face each other and the medium supporting unit 9 and the second recording head 7 face each other. In other words, the Z axis direction is a perpendicular direction.

The reeling means 12 is configured to be able to take up the paper P after recording into the form of a roll at a reeling region, which is located downstream of the recording unit 4. Though the roll paper P is described as an example of the roll-type medium, the roll-type medium is not limited to paper. For example, needless to say, the roll-type medium may be a cloth (drapery), a film, or the like. The form of the recording target medium or the medium that is to be fed is not limited to a roll. For example, it may be a so-called non-continuous sheet of paper. Next, the first recording head 5 and the second recording head 7 will now be explained in more detail.

Figure 2A:
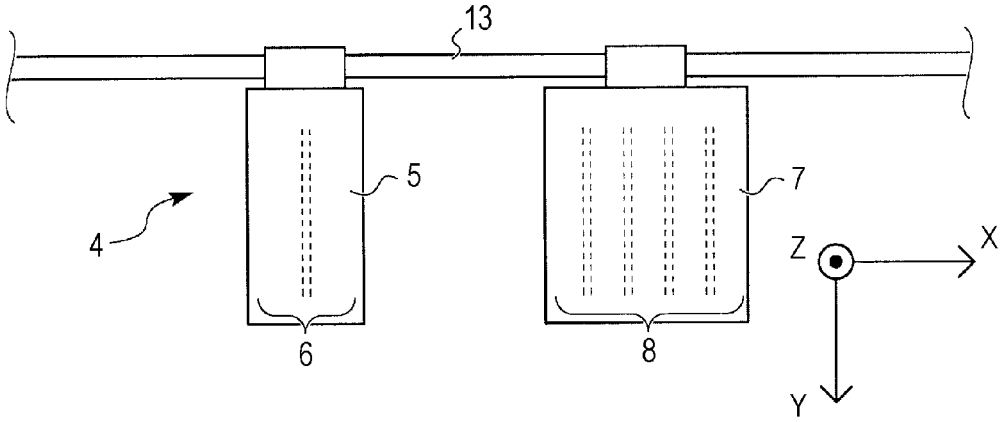
FIG. 2A is a plan view that illustrates a first recording head and a second recording head according to an exemplary embodiment of the invention.
Figure 2B:
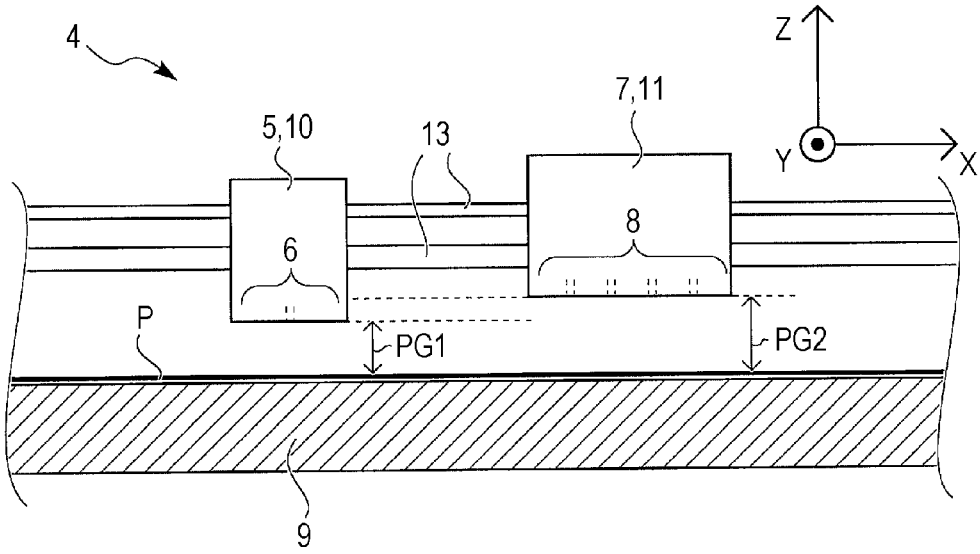
FIG. 2B is a front view that illustrates the first recording head and the second recording head according to an exemplary embodiment of the invention.

The first recording head 5 and the second recording head 7 according to the present embodiment of the invention are illustrated in FIGS. 2A and 2B. FIG. 2A is a plan view. FIG. 2B is a front view taken from the downstream side in the feeding direction. The first group of nozzles 6 and the second group of nozzles 8 are shown in a see-through view. As illustrated in FIGS. 2A and 2B, the recording unit 4 according to the present embodiment of the invention includes the first recording head 5 and the second recording head 7. The first group of nozzles 6 is formed in the first recording head 5. A first type of liquid L1 (refer to FIG. 3) is ejected from the first group of nozzles 6 onto the rolled-out paper P. The first type of liquid L1 is used for base coating. The second group of nozzles 8 is formed in the second recording head 7. A second type of liquid L2 (refer to FIG. 3) is ejected from the second group of nozzles 8 onto the base.

Herein, the "first type of liquid for base coating" is liquid that is used for forming a white base coating layer, a metal-color base coating layer, or the like. The use of the "first type of liquid for base coating" improves the color development of the "second type of liquid ejected on the base". The "second type of liquid ejected onto the base" is liquid that is ejected onto the layer H of the first type of liquid (refer to FIG. 3). Specifically, it is liquid having achromatic colors other than white or chromatic colors. Examples of the "second type of liquid ejected onto the base" are cyan, magenta, yellow, and black ink.

It is preferred that the white ink L1 be used as the "first type of liquid for base coating" for white rolled-out paper, too. This is because the color of the "second type of liquid" develops better with the use of the white ink L1 as compared with a case where it is not used.

The printer 1 according to the present embodiment of the invention has first and second recording modes. The first recording mode is a recording mode in which the first type of liquid L1 is ejected first, followed by the ejection of the second type of liquid L2 onto the layer of the first type of liquid L1 for recording. The first recording mode is used when characters, patterns, pictures, etc. that are recorded on a recording target medium such as paper are to be seen from the recording surface side (i.e., from the liquid ejection side). The second recording mode is a recording mode in which the second type of liquid L2 is ejected first, followed by the ejection of the first type of liquid L1 onto the layer of the second type of liquid L2. The second recording mode is used when characters, patterns, pictures, etc. that are recorded on a recording target medium such as a transparent film are to be seen from the side opposite the recording surface side (i.e., not from the liquid ejection side).

The first recording mode will now be explained in detail. As illustrated in FIG. 2B, in the first recording mode, the distance (hereinafter may be referred to as "paper gap", PG) PG1 between the rolled-out paper P and the first recording head 5 is shorter than the distance PG2 between the rolled-out paper P and the second recording head 7. Specifically, the printer 1 includes a first PG changing means 10 and a second PG changing means 11. The first PG changing means 10 is configured to be able to change the distance PG1 between the rolled-out paper P and the first recording head 5.

Examples of a mechanism for changing the above distance are a cam mechanism and a gear mechanism. In like manner, the second PG changing means 11 is configured to be able to change the distance PG2 between the rolled-out paper P and the second recording head 7. The first PG changing means 10 and the second PG changing means 11 are used for paper-gap control to ensure that the following relationship holds true: the distance PG1 between the rolled-out paper P and the first recording head 5 is shorter than the distance PG2 between the rolled-out paper P and the second recording head 7. Next, operational effects produced by the above relationship will now be explained.

Figure 3:
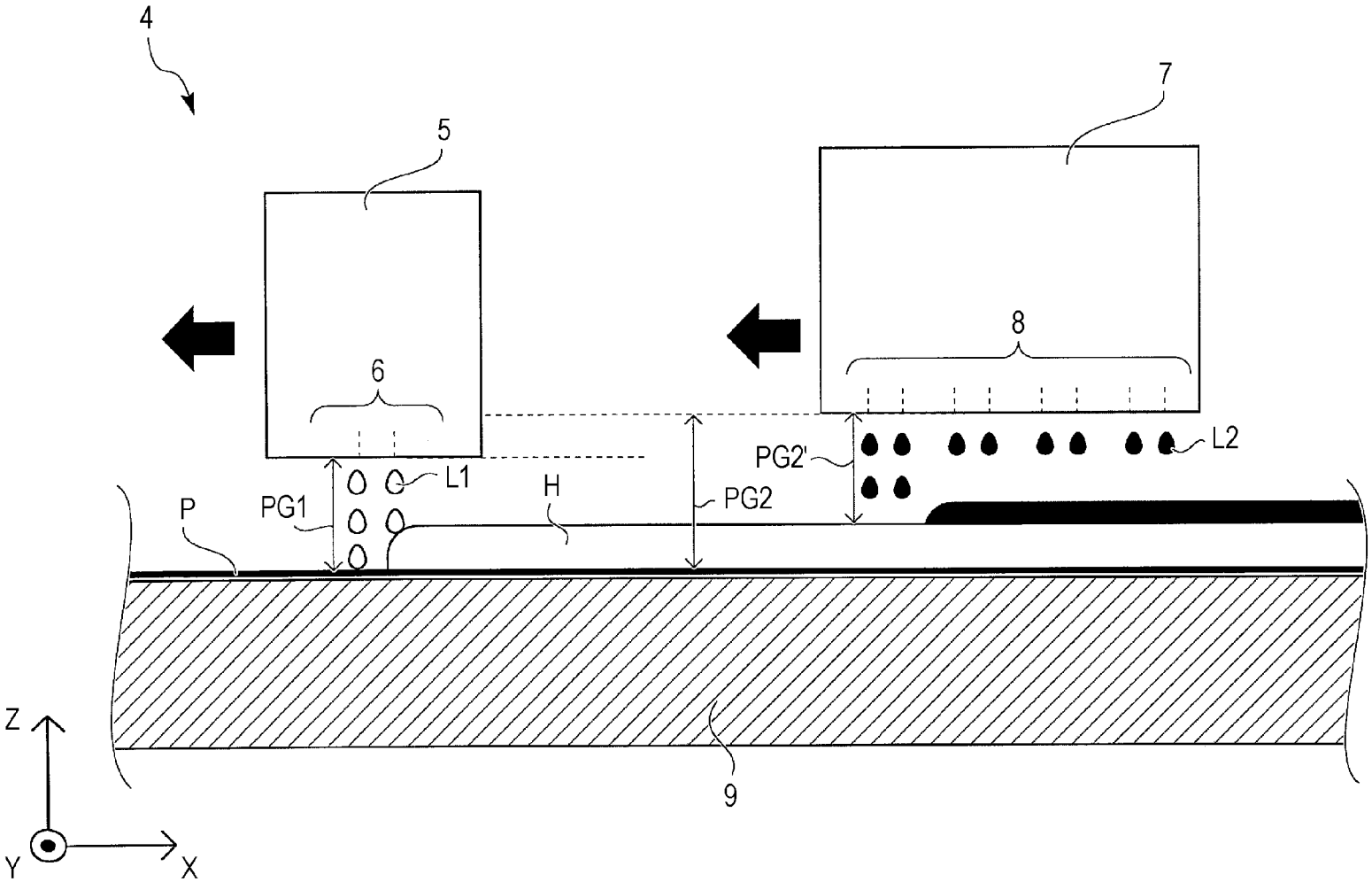
FIG. 3 is an enlarged front view that illustrates an essential part in a first recording mode according to an exemplary embodiment of the invention.

FIG. 3 is an enlarged front view that schematically illustrates an essential part in the first recording mode according to the present embodiment of the invention. As illustrated in FIG. 3, the distance PG1 between the rolled-out paper P and the first recording head 5 is shorter than the distance PG2 between the rolled-out paper P and the second recording head 7. In this example, the first type of liquid ejected from the first group of nozzles 6 of the first recording head 5 is the white ink L1 for base coating. In the following description, it is assumed that the white ink L1 is ultraviolet ray curing (solidification) ink, which is an example of photo-curable (solidification) liquid. Note that the white ink L1 is not limited to ultraviolet ray curing (solidification) ink.

An ultraviolet ray irradiation means that is not illustrated in the drawings irradiates an area where the white ink L1 has been ejected from the first group of nozzles 6 of the first recording head 5 with ultraviolet rays. As a result, a white ink layer H is formed on the recording surface of the rolled-out paper P. In general, ultraviolet ray curing (solidification) ink cures (solidifies) when exposed to ultraviolet rays. Unlike dye ink and pigment ink, each of which solidifies as a result of the vaporization of its solvent, the volume of ultraviolet ray curing (solidification) ink after curing (solidification) is almost the same as the volume of ultraviolet ray curing ink before curing. Therefore, the white ink layer H is formed as a base coating layer that has a certain thickness.

Since there is the relationship described above between the distance PG1 and the distance PG2, it is possible to make the distance PG1 between the rolled-out paper P and the first recording head 5 approximately equal to a distance PG2' between the surface of the white ink layer H and the second recording head 7 while taking the thickness of the white ink layer H into consideration. For this reason, it is possible to make conditions for ejecting color ink L2 from the second group of nozzles 8 of the second recording head 7 roughly the same as conditions for ejecting the white ink L1 from the first group of nozzles 6 of the first recording head 5. Consequently, it is possible to perform recording operation well. Moreover, there is no risk of abrasion of the white ink layer H by the nozzle surface of the second recording head 7, or in other words, the surface in which the second group of nozzles 8 is formed.

When a unidirectional printing configuration, in which ink is ejected only during the movement of a reciprocating head in one direction, is adopted, the first recording head 5 may be reciprocated three times to form a single thick white ink layer H that is made up of three tiers of white ink. When a bidirectional printing configuration, in which ink is ejected both during the movement of a reciprocating head in one direction and during the movement of the reciprocating head in the opposite direction, is adopted, the first recording head 5 may be reciprocated one and half times to form a single thick white ink layer H that is made up of three tiers of white ink. The relationship described earlier (the distance PG1 is shorter than the distance PG2) is especially effective when the white ink layer H has a given thickness.

The relative positions of the first recording head 5 and the second recording head 7 are determined depending on the thickness of the white ink layer H within a range in which the relationship described earlier holds true. It is possible to calculate the thickness of the white ink layer H by counting the number of ink droplets discharged from the first group of nozzles 6 and on the basis of the area of discharging them. Since the volume of ultraviolet ray curing (solidification) ink after curing (solidification) is almost the same as the volume of ultraviolet ray curing ink before curing, it is possible to calculate the thickness of the white ink layer H with high precision especially when ultraviolet ray curing ink is used.

The white ink layer H may be formed throughout the entire area irrespective of an area where the color ink L2 will be ejected from the second group of nozzles 8 of the second recording head 7. The white ink layer H may be formed at the area where the color ink L2 will be ejected from the second group of nozzles 8 of the second recording head 7. Needless to say, the positions of the first recording head 5 and the second recording head 7 are changed depending on the thickness of a recording target medium while keeping the relationship described earlier (the distance PG1 is shorter than the distance PG2) with the use of the first PG changing means 10 and the second PG changing means 11, respectively. For example, when recording operation is performed on a thick cardboard or a CD-R disc, the first recording head 5 and the second recording head 7 are set at relatively upper positions in the Z axis direction as compared with a case where recording operation is performed on the rolled-out paper P or plain paper.

In the foregoing embodiment of the invention, it is explained that the first recording head 5 and the second recording head 7 can move along the guiding shaft 13, that is, the same single shaft, in the same width direction. However, the scope of the invention is not limited to such an exemplary structure. For example, recording heads may move along a plurality of guiding shafts provided at different positions as viewed in the feeding direction Y. A first recording head may be provided at the upstream side in the feeding direction. A second recording head may be provided downstream of the first recording head.

Figure 4:
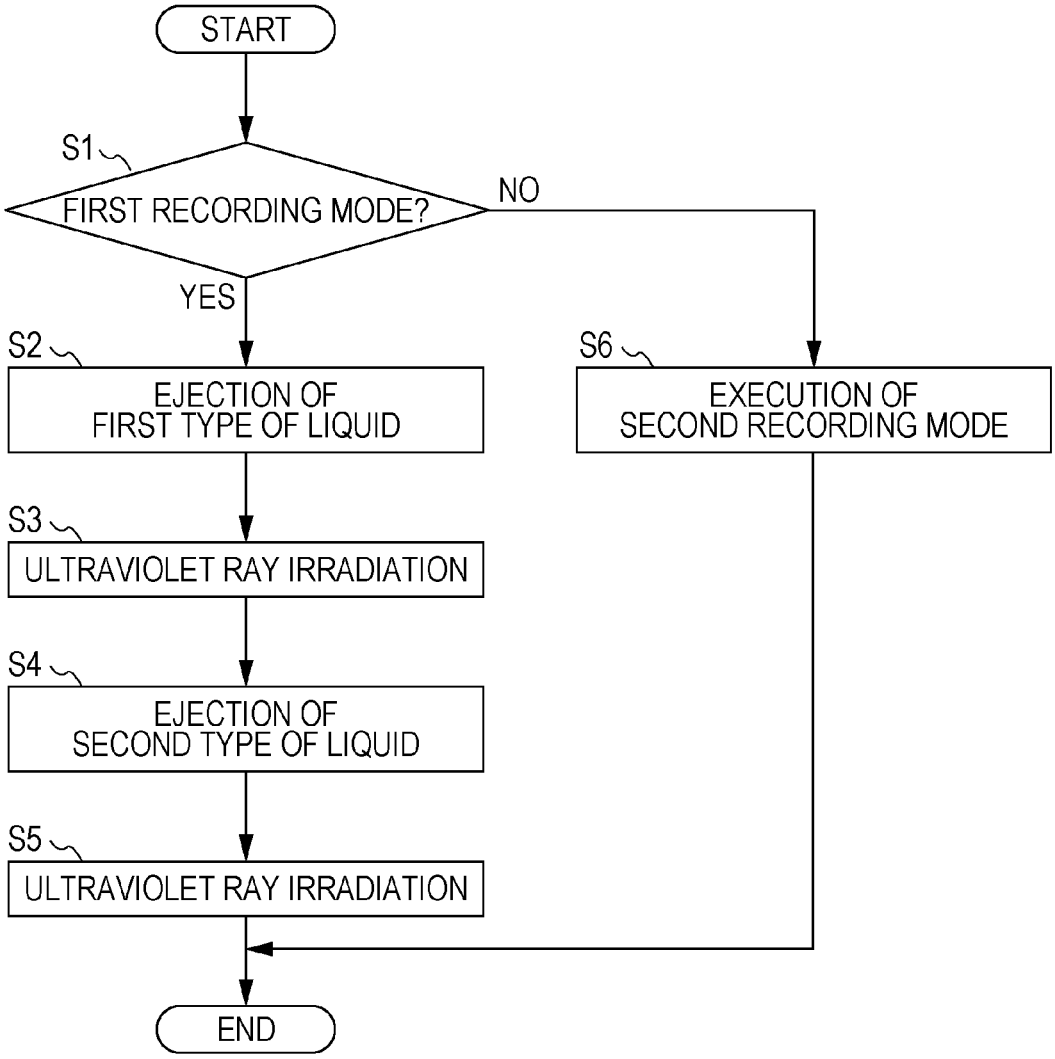
FIG. 4 is a flowchart that illustrates control in the first recording mode according to an exemplary embodiment of the invention.

Next, control in the first recording mode will now be explained. FIG. 4 is a flowchart that schematically illustrates control in the first recording mode according to the present embodiment of the invention. As illustrated in FIG. 1, in a step S1, a control unit (not shown) judges whether the mode that is currently selected is the first recording mode or not. If it is judged that the mode that is currently selected is the first recording mode, the process proceeds to a step S2 for executing the first recording mode. If not, the process proceeds to a step S6 for executing the second recording mode.

In the step S2, the white ink L1, which is an example of the first type of liquid for base coating, is ejected from the first group of nozzles 6 onto the rolled-out paper P. Then, the process proceeds to a step S3. In the step S3, an ultraviolet ray irradiation means (not shown) irradiates an area where the white ink L1 has been ejected with ultraviolet rays so as to cure the white ink L1. Then, the process proceeds to a step S4. The ultraviolet ray irradiation means may be configured as a component that moves together with the first recording head 5. The ultraviolet ray irradiation means may be separated from the first recording head 5.

In the step S4, the color ink L2, which is an example of the second type of liquid, is ejected from the second group of nozzles 8. Then, the process proceeds to a step S5. In the step S5, the ultraviolet ray irradiation means (not shown) irradiates an area where the color ink L2 has been ejected with ultraviolet rays so as to cure the color ink L2. Then, the sequence ends. In the step S6, the second recording mode is executed. The operation is not explained here. The sequence ends after the execution.

The printer 1, which is a recording apparatus according to the present embodiment of the invention, has the following features. The printer 1 includes the first group of nozzles 6 for ejecting the first type of liquid L1 for base coating onto the roll paper (rolled-out paper) P, which is an example of a recording target medium, and further includes the second group of nozzles 8 for ejecting the second type of liquid L2 onto a base formed as a result of the base coating. The distance PG1 between the first group of nozzles 6 and the roll paper P is shorter than the distance PG2 between the second group of nozzles 8 and the roll paper P.

The recording apparatus according to the present embodiment of the invention is characterized by further including the first recording head 5 that has the first group of nozzles 6 and the second recording head 7 that has the second group of nozzles 8, wherein the first recording head 5 is separated from the second recording head 7.

The recording apparatus according to the present embodiment of the invention is characterized by further including the first PG changing means 10 for changing, as a distance changer, the distance PG1 between the first recording head 5 and the roll paper P.

The recording apparatus according to the present embodiment of the invention is characterized in that each of the first type of liquid L1 and the second type of liquid L2 is photocurable ink.

The recording apparatus according to the present embodiment of the invention is characterized in that there is the first recording mode, which is a recording mode in which the second type of liquid L2 is ejected from the second group of nozzles 8 onto an area where the first type of liquid L1 has been ejected from the first group of nozzles 6.

Another Embodiment

Figure 5:
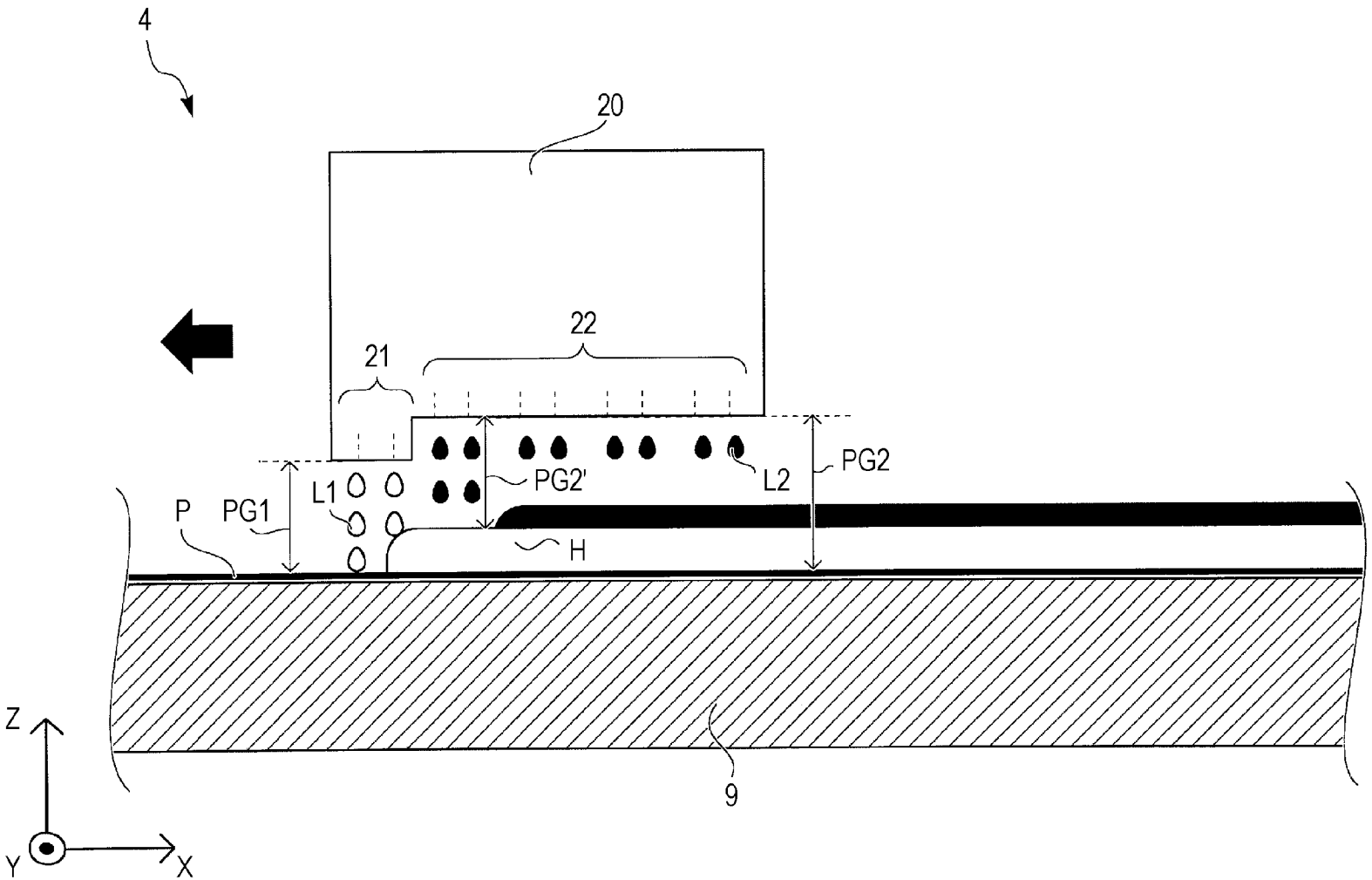
FIG. 5 is a front view that illustrates a recording head according to another embodiment of the invention.

FIG. 5 is a front view that illustrates a recording head according to another embodiment of the invention. As illustrated in FIG. 5, in this embodiment, a first group of nozzles 21 for ejecting the first type of liquid L1 and a second group of nozzles 22 for ejecting the second type of liquid L2 are formed in a single recording head 20. Components and members that are not explained here are the same as those explained in the foregoing embodiment. The same reference numerals are consistently used for the same components and members as those described in the foregoing embodiment. To avoid duplication, no mention is made here.

The distance PG1 between the surface in which the first group of nozzles 21 is formed and the roll paper P is shorter than the distance PG2 between the surface in which the second group of nozzles 22 is formed and the roll paper P. Therefore, the same operational effects as those of the foregoing embodiment can be expected. Specifically, the white ink L1, which is an example of the first type of liquid, is ejected from the first group of nozzles 21 to form the white ink layer H. There is no risk of contact of the white ink layer H with the surface in which the second group of nozzles 22 is formed.

The technical concept disclosed herein will be embodied as long as the following relationship holds true: the distance PG1 between the first group of nozzles 21, from which the first type of liquid L1 is ejected, and a recording target medium (roll paper P) is shorter than the distance PG2 between the second group of nozzles 22, from which the second type of liquid L2 is ejected, and the recording target medium. The first group of nozzles 21 and the second group of nozzles 22 may be formed in a single recording head 20 as described above. Alternatively, as in the foregoing embodiment, they may be formed in separate recording heads.

The scope of the invention is not limited to the foregoing embodiments. The invention may be modified, altered, changed, adapted, and/or improved within the scope of the recitation of appended claims. Needless to say, a recording apparatus subjected to such a modification, alteration, change, adaptation, and/or improvement is also within the scope of the invention.

What is claimed is:

1. A recording apparatus comprising:

a first nozzle for ejecting a first type of liquid toward a recording target medium; and a second nozzle for ejecting a second type of liquid toward the recording target medium;

wherein during a first recording mode, a first distance between the first nozzle and the recording target medium is shorter than a second distance between the second nozzle and the recording target medium, and the second type of liquid is ejected from the second nozzle onto an area where the first liquid has been ejected from the first nozzle, wherein during a second recording mode, the first type of liquid is ejected from the first nozzle onto an area where the second liquid has been ejected from the second nozzle, wherein during the second recording mode, the first distance is longer than the second distance.

2. The recording apparatus according to claim 1, further comprising a first recording head that has the first nozzle and a second recording head that has the second nozzle, wherein the first recording head is separated from the second recording head.

3. The recording apparatus according to claim 2, further comprising a distance changer for changing a distance between the first recording head and the recording target medium.

4. The recording apparatus according to claim 1, wherein each of the first type of liquid and the second type of liquid is photo-curable ink.

5. The recording apparatus according to claim 1, wherein the first recording mode is configured to be used when the second type of liquid is to be viewed from the liquid ejection side of the target medium, and wherein the second recording mode is configured to be used when the second type of liquid is to be viewed from a side opposite the liquid ejection side of the target medium.

6. The recording apparatus according to claim 1, further comprising a guide unit which is configured to guide a moving of the first nozzle, wherein the guide unit is configured to guide a moving of the second nozzle.

7. A recording apparatus comprising:

a first nozzle for ejecting a first type of liquid toward a recording target medium; and a second nozzle for ejecting a second type of liquid toward the recording target medium;

wherein when the second type of liquid is ejected from the second nozzle onto an area where the first type of liquid has been ejected from the first nozzle, a first distance between the first nozzle and the recording target medium is shorter than a second distance between the second nozzle and the recording target medium, wherein when the first type of liquid is ejected from the first nozzle onto an area where the second type of liquid has been ejected from the second nozzle, the first distance is longer than the second distance.

8. The recording apparatus according to claim 1, wherein the first type of liquid is a liquid for base coating.

9. The recording apparatus according to claim 1, wherein the first type of liquid is a liquid having a white color or a metal color.

10. The recording apparatus according to claim 1, wherein the second type of liquid is a liquid for image forming

11. The recording apparatus according to claim 1, wherein the second type of liquid is a liquid for character, pattern or picture forming.

12. The recording apparatus according to claim 1, wherein the second type of liquid is a liquid having achromatic colors other than white or chromatic colors.

13. The recording apparatus according to claim 7, wherein the first type of liquid is a liquid for base coating.

14. The recording apparatus according to claim 7, wherein the first type of liquid is a liquid having a white color or a metal color.

15. The recording apparatus according to claim 7, wherein the second type of liquid is a liquid for image forming

16. The recording apparatus according to claim 7, wherein the second type of liquid is a liquid for character, pattern or picture forming.

17. The recording apparatus according to claim 7, wherein the second type of liquid is a liquid having achromatic colors other than white or chromatic colors.

* * * * *